United States Patent [19]

Reedy

[11] Patent Number: 4,474,227

[45] Date of Patent: Oct. 2, 1984

[54] GAS VALVE LOCKOUT DURING COMPRESSOR OPERATION IN AN AIR CONDITIONING SYSTEM

[75] Inventor: Wayne R. Reedy, Cazenovia, N.Y.

[73] Assignee: Carrier Corporation, Syracuse, N.Y.

[21] Appl. No.: 362,782

[22] Filed: Mar. 29, 1982

[51] Int. Cl.[3] ..... F25B 29/00; F28F 27/00

[52] U.S. Cl. ..... 165/2; 165/29; 165/11 R; 62/160

[58] Field of Search ..... 165/29, 2, 12, 11 R; 62/160; 361/22, 24, 31; 340/664

[56] References Cited

U.S. PATENT DOCUMENTS

| | | | |
|---|---|---|---|
| 3,993,121 | 11/1976 | Medlin et al. | 62/160 |
| 3,996,998 | 12/1976 | Garst et al. | 165/29 |
| 4,102,390 | 7/1978 | Harnish et al. | 62/160 |
| 4,143,707 | 3/1979 | Lenis et al. | 62/160 |
| 4,147,203 | 4/1979 | Rayfield | 165/29 |
| 4,178,988 | 12/1979 | Cann et al. | 165/29 |
| 4,262,736 | 4/1981 | Gilkeson et al. | 165/29 |
| 4,307,775 | 12/1981 | Saunders et al. | 165/29 |

*Primary Examiner*—Albert W. Davis, Jr.
*Attorney, Agent, or Firm*—David L. Adour

[57] ABSTRACT

An apparatus and method are described for integrating the operation of a fossil fuel fired furnace with a heat pump. A microprocessor control is utilized to regulate the operation of the furnace such that should the compressor of the heat pump be operating even in a malfunction condition the fossil fuel fired furnace may not be energized. The logic further provides for the compressor being de-energized should the fossil fuel fired furnace be operated.

9 Claims, 6 Drawing Figures

GAS VALVE LOCKOUT DURING COMPRESSOR OPERATION IN AN AIR CONDITIONING SYSTEM

BACKGROUND OF THE INVENTION

1. Field of the Invention

The present invention relates to a combination refrigeration circuit and supplemental heating means. More specifically, this invention relates to integration of the controls of a refrigeration circuit with a supplemental heating means to prevent simultaneous operation of both.

2. Prior Art

In order to most effectively supply heating to many enclosures a reverse cycle refrigeration circuit or heat pump is often combined with a fossil fuel fired furnace. The combination of systems is then operated such that the heat pump is used to supply heat energy to a space to be conditioned when it is most economical to run the heat pump. The heat pump is then turned off and the furnace operated to supply heating to the enclosure when it is most economical to operate the furnace.

One of the potential problems of such a system is that the indoor air stream circulating air from the enclosure through the heating means typically flows over the heat exchangers of the furnace, then over the indoor heat exchanger of the refrigeration circuit serving as a condenser. If both systems were operated simultaneously the heated air is directed from the furnace heat exchangers to the condenser of the heat pump. Since this air will typically be a higher temperature than the operating design conditions of the condenser of a heat pump the condensing temperature and pressure would increase until a malfunction might occur in the heat pump system. Of course, the typical heat pump system would include a safety device to prevent overpressure conditions or high temperature operation.

The appropriate integration of the systems to prevent undue head pressures from occurring is known to be a desirable effect. The listing agencies for certifying air conditioning equipment have made it a requirement that an interlock device be provided such that simultaneous operation of the heat pump and the furnace, except in a defrost mode of operation, cannot happen.

Previous means of preventing simultaneous operation have included a switch for selecting either the heat pump heating mode or the furnace heating mode and having no provision where both may be operated. Other systems include providing a thermal sensing means in the air being supplied to the condenser for discontinuing heat pump operation should a sensing means detect a sufficiently high temperature indicating the furnace is operating.

The present invention concerns the integration of a microprocessor control into the operation of a combination heat pump and furnace system. Such a system herein is referred to as an optimizer system indicating that either the heat pump or the furnace may be operated as appropriate under the circumstances. As set forth herein, a specific terminal of the microprocessor control is energized to bring about operation of the furnace. Under the control logic the compressor is deenergized at that time. A separate logic scheme is provided to determine if the compressor is operating even though compressor operation is not being called for by the control. If this is the case then the operation of the furnace is prevented. In addition, the control determines if the furnace is operating and locks out the compressor to prevent simultaneous operation of both the heat pump and the furnace.

SUMMARY OF THE INVENTION

It is an object of the present invention to provide an integrated control for a heat pump and furnace.

It is a further object of the present invention to provide means for regulating the operation of a reversible refrigeration circuit together with supplemental heating means.

It is another object of the present invention to provide a method of operating a combination heat pump and furnace to prevent simultaneous operation of both.

It is a further object of the present invention to provide a safe, economical and efficient means for controlling the operation of a combination refrigeration circuit and supplemental heating means for conditioning an enclosure.

These and other objects of the present invention are achieved by providing apparatus and a method for integrating the operation of a reversible refrigeration circuit including a compressor and a fossil fuel fired furnace having a fuel valve for controlling fuel flow therethrough. The conditions of the space to be conditioned are sensed and the refrigeration circuit is then energized in response to a selected set of conditions and the furnace is energized in response to other selected conditions ascertained by the step of sensing. A malfunction of the compressor of the refrigeration circuit may be detected by ascertaining that the compressor is operating with the step of energizing the refrigeration circuit is not calling for compressor operation. Under these circumstances, the fossil fuel fired furnace is prevented from operating by preventing the appropriate connections to the gas valve of the fuel fired furnace from being made. In addition thereto, should the compressor motor discontinue its malfunction condition the control provides for the compressor being locked off and the furnace may operate to satisfy the space conditioning needs.

DESCRIPTION OF THE PREFERRED EMBODIMENT

Figure 6:
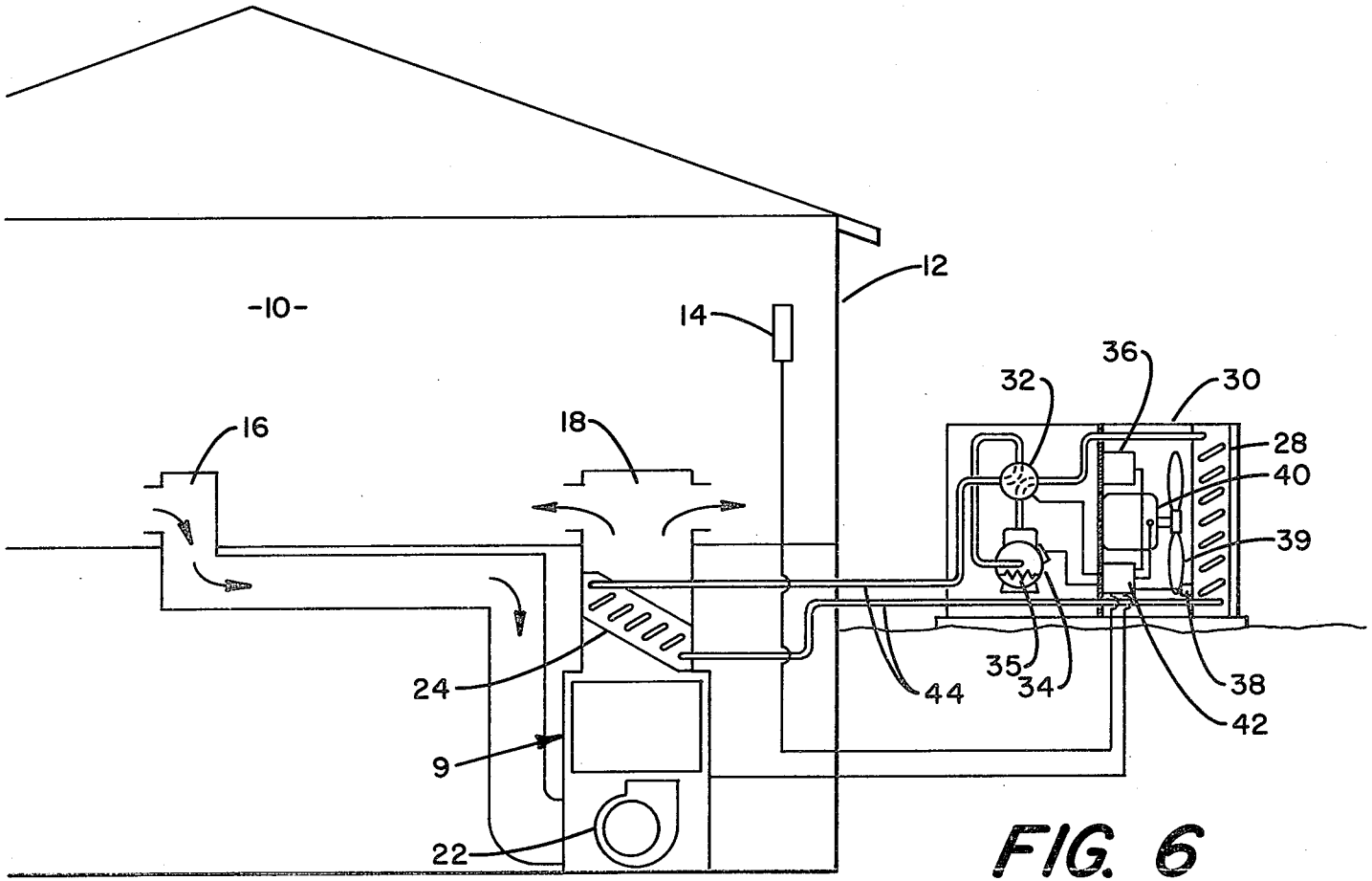
FIG. 6 is a schematic representation of a combination heat pump and furnace system which may be operated according to the principles of the present invention.

The apparatus as described herein will refer to a heat pump system for use in a residential building incorporating a microprocessor control. It is to be understood that although the present gas valve lockout in combination with the heat pump control is incorporated within a microprocessor control, the same function could be achieved through mechanical or electromechanical means. Utilization of the microprocessor control herein serves many functions in addition to the gas valve lock-out function set forth. It is further to be understood that although the present disclosure refers to a heat pump system that the reference to a system includes the utilization of a supplemental heating means including a fossil fuel fired furnace, as shown in FIG. 6.

As may be seen in the hereinafter description, the heat pump system is described having electric resistance backup heating means. It is to be understood herein that the electric resistance means could equally be a fossil fuel fired furnace and that the energization could be through a gas valve connected to the W-2' terminal of the microprocessor control such that upon a need for secondary heat the W-2' terminal is energized. In that event, instead of the electric resistance heaters being energized the gas furnace is energized. Other types of supplemental heat can be equally utilized such as propane and oil fired furnaces, solar heating systems or other heating systems.

Figure 1:
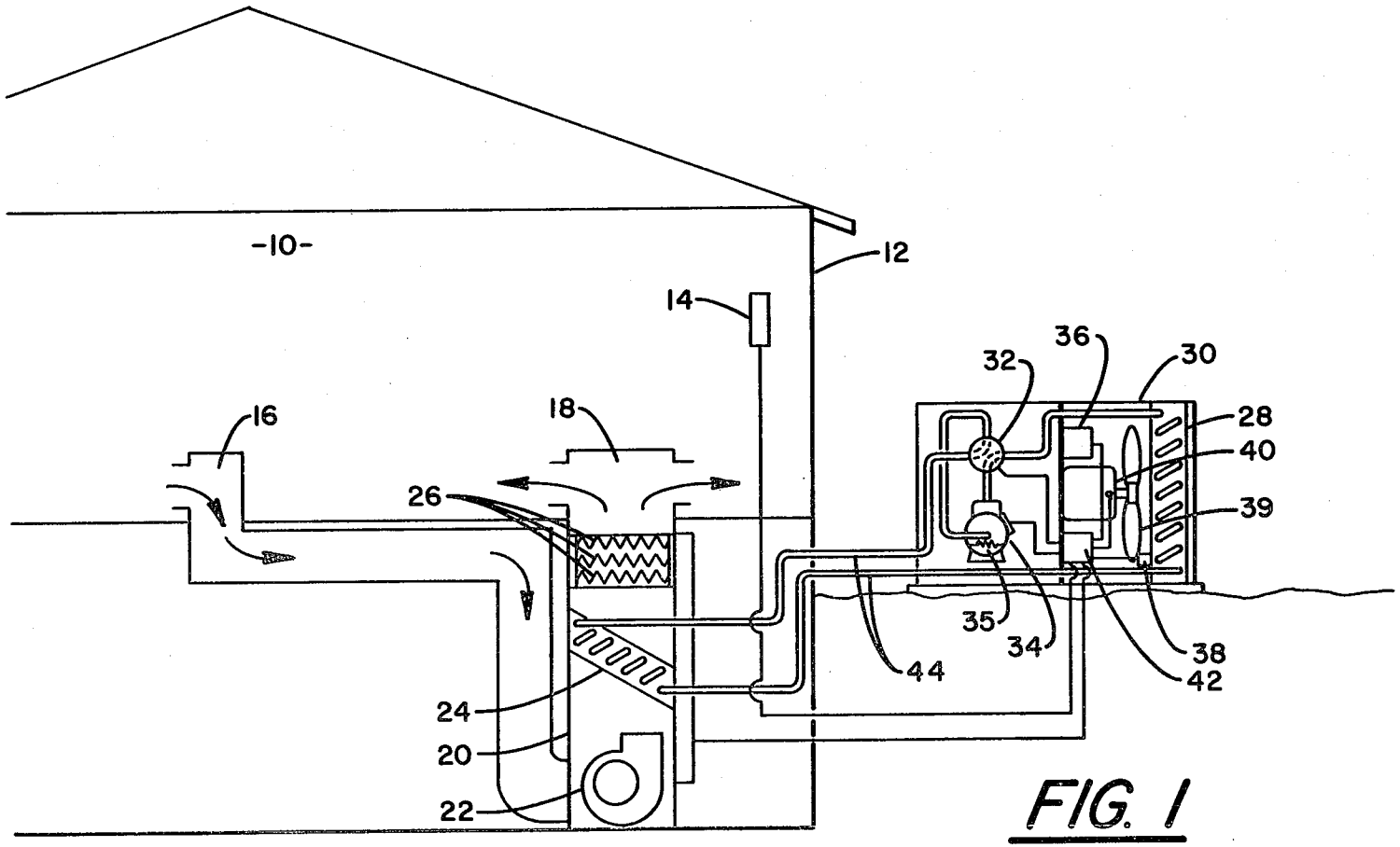
FIG. 1 is a schematic representation of a split heat pump system incorporated into a residential building.

Referring first to FIG. 1 there can be seen a schematic representation of a heat pump system. Residence 10 is shown having fan coil unit 20 located therein for circulating conditioned air within the house. Supply air duct 16 is shown directing air from the enclosure to fan coil unit 20 and return air duct 18 is shown for directing air from the fan coil unit back to the enclosure. Within the fan coil unit 20 may be seen indoor fan 22, indoor heat exchanger 24 and strip heaters 26. Indoor fan 22 acts to circulate the air through the supply duct, through the indoor heat exchanger and strip heaters and back through the return air duct to the enclosure. Indoor heat exchanger 24 is part of a refrigeration circuit and acts to either discharge heat to the air stream directed thereover via indoor fan 22 or to absorb heat energy therefrom. Strip heaters 26 are located downstream from indoor heat exchanger 24 and may be selectively energized to supply heat energy to the air stream flowing through the fan coil unit.

Outdoor unit 30 is shown located exterior of residence 10 and is typically mounted on a pad located adjacent thereto. Within outdoor unit 30 may be seen outdoor coil 28 of the refrigeration circuit, compressor 34 and reversing valve 32. Additionally, there can be seen outdoor fan 39 connected to outdoor fan motor 40 for circulating ambient air over outdoor coil 28. Outdoor temperature sensor 36, outdoor coil temperature senser 38, crankcase heater 35 and control 42 are also indicated to be within the outdoor unit. Likewise, thermostat 14 as well as electrical connections to strip heaters and the indoor fan motor for powering indoor fan 22 are designated.

The refrigeration circuit is made up of indoor coil 24, outdoor coil 28, compressor 34, reversing valve 32 and interconnecting piping 44. Expansion devices for accomplishing pressure drops between the components of the refrigeration circuit are not shown.

During operation of this unit in the heating season, heat energy is absorbed in the outdoor coil 28 acting as an evaporator and discharged to indoor air via indoor heat exchanger 24 serving as a condenser. In the cooling mode of operation the reversing valve is switched such that hot gaseous refrigerant from the compressor is directed first to the outdoor coil 28 serving as a condenser and then directed to the indoor coil 24 serving as an evaporator for absorbing heat energy from the indoor air.

Figure 2:
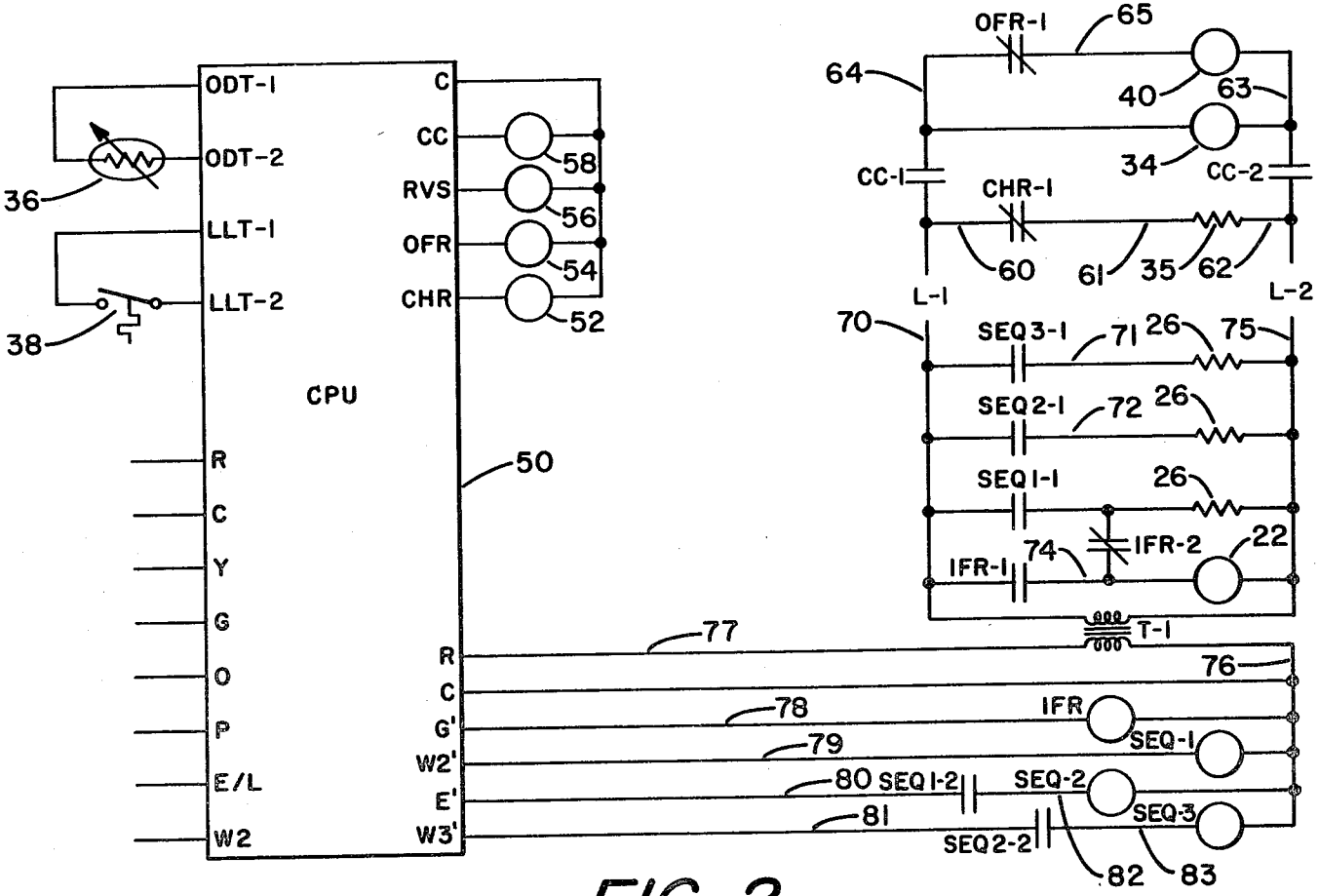
FIG. 2 is a schematic wiring diagram of the controls of the heat pump system.

Referring now to FIG. 2, there can be seen a schematic representation of the control system of this unit. In the left hand portion of FIG. 2 is shown, greatly enlarged, a central processing unit 50. Typically, this would be a commercially available microprocessor such as a Mostek 3870. It can be seen that the microprocessor has a plurality of inputs and outputs. Starting from the top left it can be seen that outdoor air temperature sensor 36 is connected through ODT-1 and ODT-2 to the central processing unit. Additionally, outdoor coil temperature sensor 38 is shown connected to the CPU through LLT-1 and LLT-2. Thereafter, a series of eight thermostat inputs labeled R, C, Y, G, O, P, E/L and W-2 are shown entering the central processor unit. In sequential order, these thermostat inputs are as follows: R—Power to the thermostat from the CPU; C—Common; Y—First stage heating; G—Energize indoor fan relay; O—First stage cooling (reversing valve); P—Power to the central processing unit from the thermostat; E/L—Emergency heat or fault light; W-2—Second stage heat.

On the right hand side of the central processing unit there may be seen connections to various relays. Crankcase heater relay 52, outdoor fan relay 54, reversing valve solenoid relay 56 and compressor contactor 58 are all shown connected to the appropriate compressor, reversing valve solenoid, outdoor fan relay, and crankcase heater relay connections of CPU 50. The CPU is programmed such that upon an appropriate set of inputs being sensed these relays will be energized.

At the bottom right hand side of the central processing unit 50 there are shown six connection points labeled respectively R, C, G', W-2', E' and W-3'. In order, these connections are R—Power, C—Common, G'—Indoor fan relay, W-2'—First stage heat, E'—Second stage heat and W-3'—Third stage heat. As can be seen in FIG. 2, the R connection is connected via wire 77 to one side of transformer T-1. The C connection is connected via wire 76 to the other side of transformer T-1. G' is connected via wire 78 to indoor fan relay IFR. Wire 79 connects W-2' to sequence relay SEQ-1. The E' terminal is connected via wire 80 to first sequence relay contacts SEQ1-2 which are connected by wire 82 to second sequence relay SEQ-2. Contact W-3' is connected via wire 81 to second sequence relay contacts SEQ2-2 which are connected by wire 83 to third sequence relay SEQ-3. In an optimizer system the W-2' terminal may be connected to the gas valve of the furnace and the E; and W-3' terminals left unused.

As shown in FIG. 2, lines L-1 and L-2 supply power to the fan coil unit and CPU. Line L-1, designated wire 70, is connected to normally open first sequence relay contacts SEQ1-1, normally open second sequence relay contacts SEQ2-1, to normally open third sequence relay contacts SEQ3-1, to normally open indoor fan relay contacts IFR-1 and to transformer T-1. Line L-2, designated as 75, is connected to heaters H1, H2 and H3, all designated as 26, to transformer T-1 and to indoor fan motor 22. Wire 71 connects normally open third sequence relay contacts SEQ3-1 to heater H3. Wire 72 connects normally open second sequence relay contacts SEQ2-1 to heater H2. Wire 73 connects normally open first sequence relay contacts SEQ1-1 to heater H1 and to normally closed indoor fan relay contacts IFR-2. Wire 74 connects normally open indoor fan relay contacts IFR-1 and normally closed indoor fan relay contacts IFR-2 to indoor fan motor 22.

Power wiring of the outdoor unit may be seen in the top portion of FIG. 2. Therein connected between power lines L-1 and L-2 is wire 60 connected to normally open compressor contacts CC-1 and to normally closed crankcase heater relay contacts CHR-1. Wire 61 connects normally closed crankcase heater relay contacts CHR-1 with crankcase heater CCH (35). Crankcase heater 35 is connected via wire 62 to line L-2 and to normally open compressor contactor contacts CC-2. Wire 64 connects normally open compressor contactor contacts CC-1 to normally closed outdoor fan relay contacts OFR-1 and to compressor motor 34. Wire 65 connects normally closed outdoor fan relay contacts OFR-1 to outdoor fan motor 40. Normally open compressor contactor contacts CC-2 are connected via wire 63 to compressor motor 34 and to outdoor fan motor 40.

Figure 3:
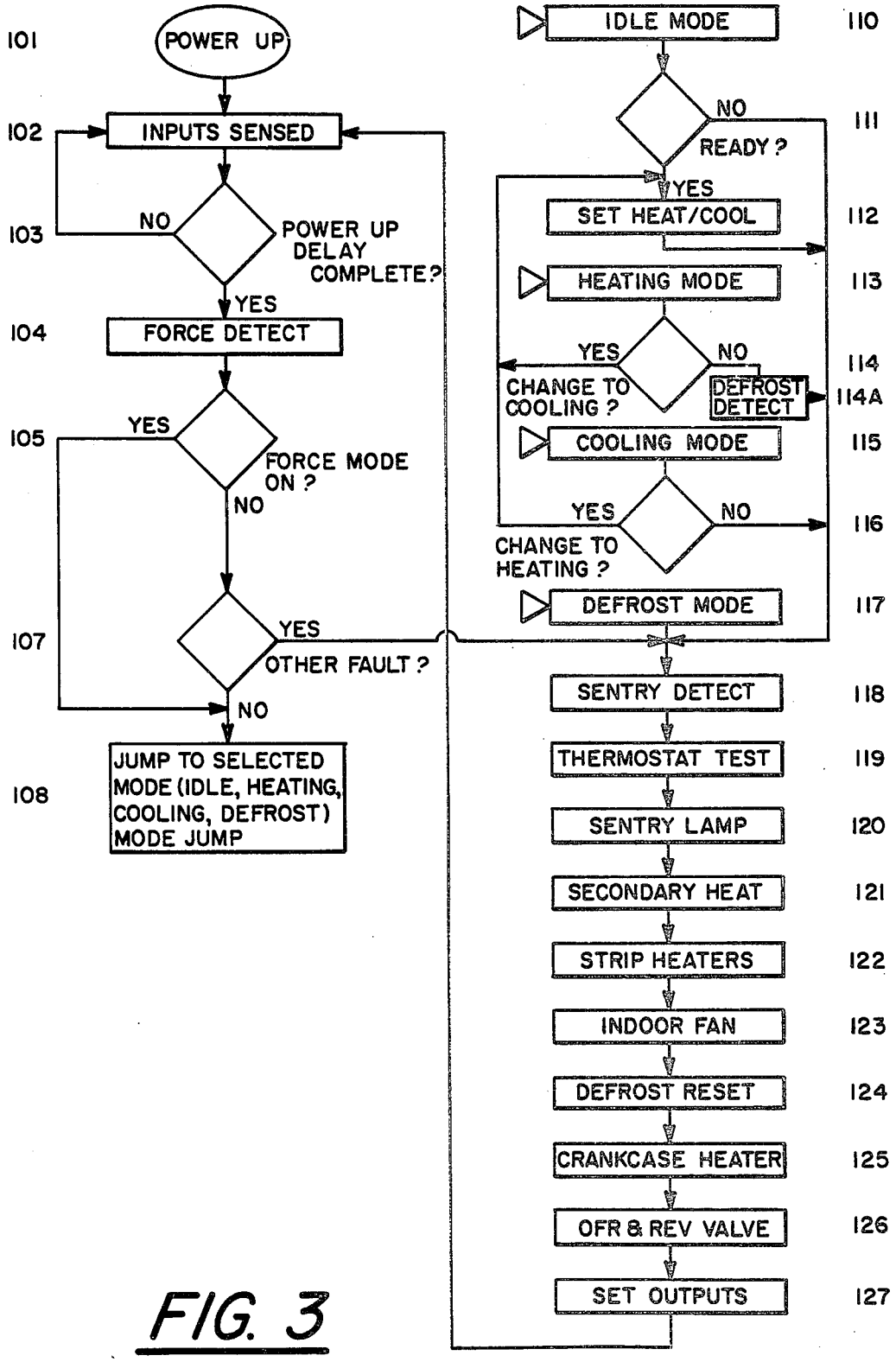
FIG. 3 is a flow diagram of the summary of the operation of the microprocessor control for the heat pump system.

FIG. 3 is a flow chart indicating the overall operation of the control system. It can be seen that the overall system control is obtained by logic flow through a series of logic steps. Each logic step may represent a subroutine or series of steps omitted for clarity in this overall chart. The initial step 101 is the powerup of the unit upon energization. Thereafter at step 102 the various inputs are sensed. To make sure the inputs are stabilized and debounced a powerup delay occurs before proceeding to force detect step 104. If the powerup delay is not complete then there is a reversion to the step of sensing inputs until said delay is accomplished. Force detect, step 104, determines whether or not the compressor is operating when it is not supposed to be. This step would detect a condition such as a contactor welded closed energizing the compressor when the various inputs are calling for the compressor to be deenergized. Step 105 determines whether the force mode is detected. If the force mode is detected then the program skips to step 108 wherein the logic jumps to the selected mode. If, in step 105, the force mode is not detected then the logic proceeds to step 107. At step 107 there is a determination whether there is another fault in the system. If there is no other fault the logic proceeds to step 108, the jump to the selected mode, one of the modes of idle, heating, cooling or defrost. If another fault is detected then the control logic jumps to step 118, sentry detect.

If in step 108 the jump is selected to the idle mode then the logic proceeds to step 110. Thereafter, at step 111, a ready determination is made and if the answer is no the logic jumps to step 118 without placing the unit in heating or cooling. If the answer to step 111 is yes the logic proceeds to step 112 and the air conditioning unit is placed in heating or cooling in step 112. The logic then jumps to step 118.

If the jump to the selected mode selects the heating mode then the jump is made to step 113. Once operation is in the heating mode the question of should operation be changed to cooling is continually answered at step 114. If the answer is yes, the logic is cycled back to step 112 of setting the unit in heat or cool and if the answer is no logic operation proceeds to step 114A, defrost detect. If a need for defrost is detected the logic changes the mode from heating to defrost and then jumps to step 118. If a need for defrost is not detected the logic does not change the mode and then jumps to step 118.

If in step 108 the selection is the cooling mode then the logic proceeds to step 115. Step 116 continually questions if operation should be changed to heating. If the answer is yes the control sequence proceeds back to the step 112 of setting the unit for heating or cooling. If the answer is no the logic jumps to step 118.

The fourth mode jump is to the defrost mode, step 117. This step in the logic either continues or cancels the defrost mode of operation. If the jump is made to the defrost mode thereafter the logic proceeds through the entire control sequence. From the defrost mode the control sequence includes the steps of sentry detect 118, thermostat test 119, sentry lamp 120, secondary heat 121, strip heaters 122, indoor fan 123, defrost reset 124, crankcase heater 125, OFR plus REV valve 126 and set outputs 127. From the step of set outputs 127 the control sequence reverts to inputs sensed step 102.

The sentry detect step acts to check the compressor for low current or for ground fault indication. The thermostat test checks to make sure the inputs from the thermostat are in a legal pattern. The sentry lamp step acts to blink a thermostat lamp to indicate various fault modes. Secondary heat controls the W-2 output from the central process unit. The step of strip heaters 122 control the E' and W-3' outputs from the central processing unit. Indoor fan step 123 controls indoor fan 22. Defrost reset determines when a defrost timer for controlling the length of defrost needs to be reinitialized. Crankcase heater, step 125, acts to control the crankcase heater operation. OFR plus REV valve, step 126, acts to control the outdoor fan relay and the reversing valve relays under the appropriate conditions. Step 127 for setting the outputs turns on and off the central processing unit outputs and detects when the compressor is changing state.

Figure 4:
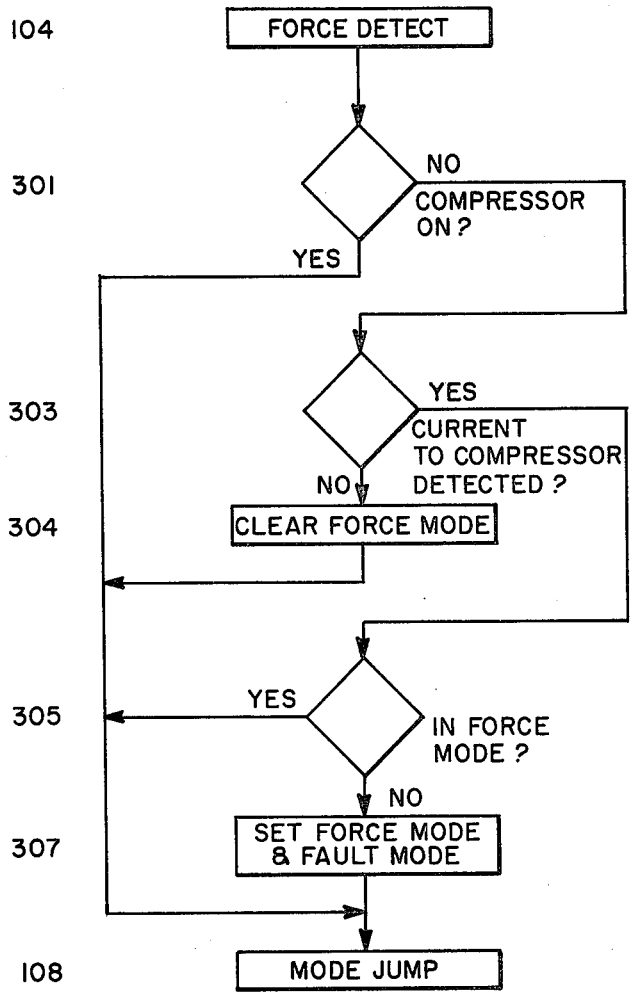
FIG. 4 is a flow chart of a portion of the logic of the microprocessor control for determining compressor malfunction.

Referring more specifically to FIG. 4 there can be seen a portion of the logic of the microprocessor control utilized to determine a compressor malfunction. From logic step 104, force detect, the logic flows to step 301 to determine whether or not the compressor is on. This step determines whether or not the logic is calling for the compressor to be energized. If the answer is yes the logic proceeds to step 108, mode jump. If the answer to whether or not the control is calling for the compressor to be energized is no the logic then proceeds to step 303 to determine whether or not current to the compressor is detected. If the answer to step 303 is yes the logic then proceeds to step 305 to determine whether or not the unit is in the force mode of operation. If the answer to step 305 is no the logic proceeds to step 307 and sets the unit mode control in the force mode. Thereafter the logic proceeds to mode jump. At step 303 it is determined whether or not current is sensed flowing to the compressor. Typically, this current may be sensed by locating a current transformer adjacent one of the power connections to the compressor motor. Such controls are known in the air conditioning industry. If the answer to step 303 is no the logic flows to step 304 to clear the force mode. If the answer to step 305 is yes the logic then flows to mode jump 108.

Figure 5:
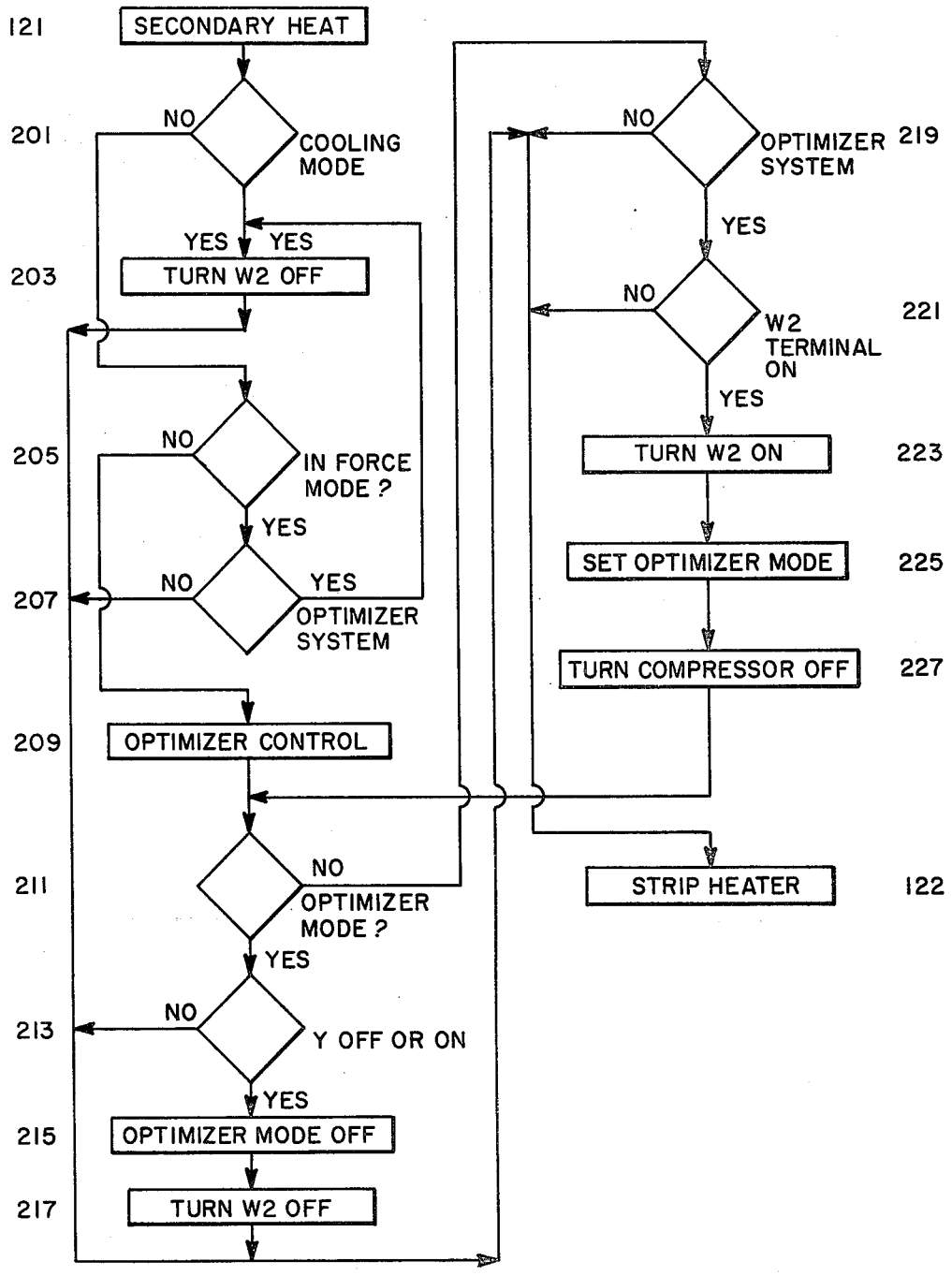
FIG. 5 is a flow chart of the control for determining the appropriate initiation of secondary heat, including the fossil fuel fired furnace.

Referring now to FIG. 5 there may be seen a logic diagram of another portion of the control system. Therein it may be seen that the logic flows from secondary heat step 121 to step 201 to determine whether or not the unit is in the cooling mode. If the unit is not in the cooling mode of operation the logic then proceeds to step 205 to determine whether or not it is in the force mode. If the unit is not in the force mode it then proceeds to optimizer control step 209. If in the secondary heat mode and it is determined that the unit is in the force mode as may be ascertained in step 307, shown in FIG. 4, then the logic flows to step 207 to determine whether or not it is an optimizer system. An optimizer system refers to a combination of a fossil fuel fired furnace 9 with a heat pump, as shown in FIG. 6, wherein reference numerals identical to those in FIG. 1 identify like elements. If the answer to this question is no the logic proceeds to step 122, strip heaters. If it turns out the unit is an optimizer system and in the force mode then the logic proceeds to step 203 to turn terminal W-2' off. By turning terminal W-2' off operation of the fossil fuel fired furnace 9 is prevented since W-2' is connected to energize the gas valve. The logic from step 203 flows to strip heaters 122. If from secondary heat step 121 the logic flows to step 201 and the unit is in the cooling mode of operation indicating that it should not be supplying secondary heat the logic then proceeds to step 203 to turn the W-2' terminal off.

Within the optimizer control subroutine indicated as optimizer control 209 it can be seen that the logic flows to step 211 to determine whether or not the unit is in the optimizer mode. If the answer is yes the logic flows to step 213 to determine whether or not the Y terminal is off or the O terminal is on. If the answer to this question is yes the logic then proceeds to step 215 and turns the optimizer mode off and then to step 217 to turn terminal W-2' off. If either the Y terminal is off or the O terminal is on, the Y terminal being off indicating that there is no need for heating and the O terminal being on indicating that a cooling need is sensed, then the logic proceeds to strip heater step 122. If at step 211 it is determined that the unit is not in the optimizer mode then the logic proceeds to step 219 to question whether or not it is an optimizer system. If the answer is no the logic flows to strip heater step 122. If the answer is yes it is an optimizer system the logic then proceeds to step 221 to determine whether the W-2 terminal of the thermostat indicating a need for secondary heating is on. If the answer is no the logic proceeds to strip heater step 122. If the answer is yes that the W-2 terminal is on calling for second stage heating the logic proceeds to step 223 to turn the W-2' terminal on to energize the furnace 9. The logic then proceeds to set the system in the optimizer mode such that step 211 will be answered in the affirmative. The logic then proceeds to turn the compressor off at step 227 and flow back to step 211 to determine whether or not the unit is in the optimizer mode.

As applied throughout the control, the logic as shown in FIG. 4 determines whether or not current is being supplied to the compressor notwithstanding that the logic is calling for the compressor not to be operated. If this condition exists, such as the compressor contacts being welded shut or some other fault, then the unit is indicated as being in the force mode and a flag is set to so indicate.

Referring then to the logic as summarized in FIG. 5, if the unit is calling for secondary heat because the heat pump has been insufficient to satisfy the heating needs of the enclosure or the outdoor ambient temperature is such that the logic has determined that it is more efficient to operate a fossil fuel fired furnace, then it determines first whether or not the system is in the cooling mode. If it is in the cooling mode the logic proceeds to turn the W-2' terminal connected to the gas valve of the fossil fuel fired furnace off. If the unit is not in the cooling mode then the logic proceeds to determine whether or not a force mode flag as determined in FIG. 4 is set. If the unit is in the force mode the logic then proceeds to question whether or not it is an optimizer system. If it is an optimizer system and there is a malfunction detected indicating that the compressor is operating when the control is not calling for it to operate the logic then proceeds back to step 203 to turn the W-2' terminal off thereby locking out the furnace such that it may not be operated while the compressor is operating. Hence, it may be seen that the logic provides for the deenergization of the furnace in the heating mode if the compressor is maintained on. Should the force mode be cleared at step 304 then the lockout of the furnace will be discontinued.

During normal switching from compressor operation to furnace operation and during switching after a fault where the compressor has continued operating although the control has not called for such operation, the logic proceeds as set forth in the optimizer control portion of FIG. 5. Therein it is first determined whether or not the system is in the optimizer mode. If the answer is no the logic proceeds to step 219 to determine if it is an optimizer system. It is determined whether or not it is an optimizer system via a jumper wire provided in the control which is cut by the installer when a heat pump incorporating the control board is connected to the fossil fuel fired furnace 9 as shown in FIG. 6. If this jumper has been cut and the answer at logic step 219 is yes, the logic then proceeds to step 221 to determine if a second stage heating need is being detected. If the answer is yes then the W-2' terminal to energize the furnace 9 is turned on and the unit is placed in the optimizer mode and the compressor is turned off. Hence, operation of the compressor in combination with the furnace 9 is also not allowed. Therefore, the compressor is turned off in step 227 based upon switching either to secondary heating under normal conditions at step 227 or based upon the discontinuance of compressor operation after a fault condition as may be detected by the force detect step set forth in FIG. 4.

As set forth herein there has been described a control system incorporating a microprocessor to determine how to integrate the operation of a compressor of a heat pump system with a fossil fuel fired furnace. As set forth in the logic described above it is apparent that the heat pump system cannot be operated simultaneously with the furnace to provide heating to the enclosure. Operation of the furnace to supply heating when the heat pump is in the defrost mode has not been discussed herein and may occur entirely separate from the logic as set forth. Although this invention has been described incorporating a microprocessor control it is to be understood that the same result can be achieved using mechanical, electromechanical or manual means.

The invention has been described herein with reference to a particular embodiment. It is to be understood by those skilled in the art that variations and modifications can be effected thereto.

1. Control apparatus for safely integrating the operation of a reversible refrigeration circuit including a compressor, indoor heat exchanger and an outdoor heat exchanger and a supplemental heating means located upstream of the indoor heat exchanger including initiation means for commencing operation of the supplemental heating means which comprises:

sensing means for determining which of the refrigeration circuit or the supplemental heating means to operate to supply heat energy to a space to be conditioned;

control means acting in response to the sensing means for initiating compressor operation to supply heating to the space by operation of the refrigeration circuit, and for energizing the initiation means for operating the supplemental heating means to supply heating to the space;

said control means further including means to detect a malfunction including compressor operation when compressor operation is not desired;

said control means including means for preventing operation of the supplemental heating means in response to the control means detecting compressor operation when compressor operation is not desired;

said control means also including means for determining if the compressor was operating pursuant to a malfunction and has since discontinued operation; and said control means including means for inhibiting the compressor from operation until the furnace has satisfied the space heating needs as determined by the step of sensing.

2. The apparatus as set forth in claim 1 and further comprising current sensing means for detecting current flow to the motor of the compressor.

3. The apparatus as set forth in claim 2 wherein the control means further comprises means for determining if the compressor should be energized, means connected to the current sensing means for determining when the compressor is energized and indicator means set to indicate a malfunction mode of operation if the means connected to the current sensing means determines the compressor is operating when the means for determining if the compressor should be energized indicates it should be de-energized.

4. The apparatus as set forth in claim 3 wherein the control means determines if the indicator means is present prior to initiating operation of the supplemental heating means.

5. The apparatus as set forth in claim 4 wherein the control means further prevents operation of the supplemental heating means when the indicator means is present.

6. A method of integrating the operation of a reversible refrigeration circuit including a compressor and an indoor heat exchanger and a fossil fuel fired furnace having a fuel valve for controlling fuel flow therethrough located upstream from the indoor heat exchanger which comprises the steps of:

sensing the conditions of the space to be conditioned;

energizing the refrigeration circuit in response to selected conditions ascertained by the step of sensing;

energizing the furnace in response to other selected conditions ascertained by the step of sensing;

detecting a malfunction by the compressor of the refrigeration circuit operating when the step of energizing the refrigeration circuit is not calling for compressor operation;

preventing the fossil fuel fired furnace from being energized when the step of detecting ascertains a malfunction;

determining if the compressor was operating pursuant to a malfunction and has since discontinued operation; and inhibiting the compressor from operation until the furnace has satisfied the space heating needs as determined by the step of sensing.

7. The method as set forth in claim 6 wherein the step of detecting a malfunction includes the steps of:

ascertaining if the step of energizing is calling for the compressor to be energized;

determining if the compressor is energized and the step of ascertaining indicates the compressor should not be energized.

8. The method as set forth in claim 7 wherein the step of energizing the furnace includes energizing a terminal of a microprocessor which acts to supply power to the gas valve of the furnace and wherein the step of preventing operation of the furnace includes not energizing said terminal.

9. The method as set forth in claim 7 wherein the step of determining if the compressor is energized includes sensing if current is flowing to the motor powering the compressor.

* * * * *